US010301722B2

(12) United States Patent
Matteazzi

(10) Patent No.: US 10,301,722 B2
(45) Date of Patent: May 28, 2019

(54) METHOD FOR FORMING A COATING ON A SOLID SUBSTRATE

(71) Applicant: Paolo Matteazzi, Treviso (IT)

(72) Inventor: Paolo Matteazzi, Treviso (IT)

( * ) Notice: Subject to any disclaimer, the term of this patent is extended or adjusted under 35 U.S.C. 154(b) by 418 days.

(21) Appl. No.: 14/910,404

(22) PCT Filed: Aug. 7, 2014

(86) PCT No.: PCT/IB2014/063774
§ 371 (c)(1),
(2) Date: Feb. 5, 2016

(87) PCT Pub. No.: WO2015/019316
PCT Pub. Date: Feb. 12, 2015

(65) Prior Publication Data

US 2016/0186331 A1 Jun. 30, 2016

(30) Foreign Application Priority Data

Aug. 8, 2013 (IT) ..... TV2013A0132

(51) Int. Cl.
*C23C 24/04* (2006.01)
*C23C 24/10* (2006.01)

(52) U.S. Cl.
CPC ..... *C23C 24/103* (2013.01); *C23C 24/04* (2013.01)

(58) Field of Classification Search
CPC ..... C23C 24/103; C23C 24/04
See application file for complete search history.

(56) References Cited

U.S. PATENT DOCUMENTS

| | | | |
|---|---|---|---|
| 5,302,414 A | 4/1994 | Alkhimov et al. | |
| 7,402,277 B2 | 7/2008 | Ayer et al. | |
| 2007/0098913 A1 | 5/2007 | Raybould | |
| 2014/0147601 A1* | 5/2014 | Farmer | C23C 4/08 427/543 |

FOREIGN PATENT DOCUMENTS

| | | | |
|---|---|---|---|
| CN | 102071419 | A | 5/2011 |
| EP | 0665770 | B1 | 1/1997 |
| EP | 1383610 | B1 | 3/2006 |
| EP | 1873190 | A1 | 1/2008 |
| EP | 1670607 | B1 | 4/2008 |
| IT | 1399822 | B1 | 5/2013 |
| WO | 2005079209 | A2 | 9/2005 |
| WO | 2006109956 | A1 | 10/2006 |
| WO | 2012085782 | A1 | 6/2012 |

OTHER PUBLICATIONS

PCT International Search Report and Written Opinion dated Feb. 4, 2015 for Intl. App. No. PCT/IB2014/0636774, from which the instant application is based, 11 pgs.
Wang H T et al., "Effect of heat treatment on the microstructure and property of cold-sprayed nanostructured FeA1/A1203 intermettalic composite coating," Vacuum, Pergamon Press, GB, vol. 83, No. 1, Sep. 4, 2008, pp. 146-152.
Prof. Laszlo Takacs, "Self-Propagating Reactions Induced by Mechanical Alloying," Material Matters, Jan. 1, 2007, 2.4, 21, 7 pages.
Yaping Bai et al., "The mechanical alloying mechanism of various Fe203-A1-Fe systems," Advanced Powder Technology, vol. 24, No. 1, Jan. 1, 2013, pp. 373-381.

* cited by examiner

*Primary Examiner* — Xiao S Zhao
(74) *Attorney, Agent, or Firm* — Fredrikson & Byron, P.A.

(57) ABSTRACT

A method for forming a surface coating on at least a part of a solid substrate, comprising a step of cold spraying a flow comprising at least one carrier gas, and particles suitable for deposition on the said substrate, said flow having a speed of more than 350 m/s; The particles are obtained from inorganic materials and have dimensions smaller than 200 μm. One or more mixtures of reaction precursor reagents are present in at least some of the particles. The mixtures are obtained from at least one pair of phases. The mixtures of reaction precursor reagents are characterized by at least one reaction having an adiabatic temperature of at least 800 ° C.

15 Claims, No Drawings

METHOD FOR FORMING A COATING ON A SOLID SUBSTRATE

RELATED APPLICATIONS

This application is a 35 U.S.C. 371 national stage filing from International Application No. PCT/IB2014/063774, filed Aug. 7, 2014, which claims priority to Italian Application No. TV2013A000132, filed Aug. 8, 2013, the teachings of which are incorporated herein by reference.

INTRODUCTION

The present invention relates to a method for forming a coating on a solid substrate, and to an article thus obtained.

In particular, the present invention relates to the formation of a coating, on the whole of or also only in localized zones, of a solid substrate using powders.

The inventor wishes to emphasize immediately that in this context the concepts of "reaction" and "phase transformation" have the same meaning and this justifies the fact that, in the text of the present patent, one or other of the corresponding terms may be equally well used. The terms "reaction" and "phase transformation" are used respectively in the chemical and materials science sectors to describe a transition between one (organized, aggregated, physical or other) system state to another state which may be characterized thermodynamically by means of a variation of the free energy (between initial state and final state). The variation in free energy is composed of a variation in entropy (related to temperature) and a variation in enthalpy which corresponds to the heat, produced or absorbed, by the transition (or reaction or transformation). In this connection, since used in this patent, the definition of adiabatic temperature is mentioned. It is calculated by the ratio of the reaction (or phase transformation) heat and the specific heat of the reaction (or phase transformation) products. In other words, the adiabatic temperature corresponds to the increase in temperature (and therefore relates to exothermic conditions) which would occur in the presence of a reaction (or phase transformation) which is completed at 100%.

PRIOR ART

For several years now a technique, known as "cold spraying", has been widely used for depositing a powder on a solid substrate in order to perform coating of the substrate. This technique is substantially based on the teachings provided in U.S. Pat. No. 5,302,414 where it is envisaged applying onto the substrate to be coated a jet consisting of the powder mixture to be deposited and a carrier gas. Before mixing the carrier gas is heated to a temperature lower than the melting temperature of the material of the powder particles which have dimensions more or less of between 1 and 50 μm (1-50×10-3 millimeters). Owing to the fact that the jet is expelled from a convergent-divergent nozzle (Laval nozzle), the impact of the jet on the substrate occurs at a speed of more than 350 m/s. In this patent various types of materials which are designed to form the coating of a substrate are listed, but any phase transformation during formation or application of the coating is categorically excluded.

From EP 1383610 it is also known to coat a solid substrate with powders which form with the carrier gas a flow which is expelled from a nozzle at a speed not greater than the speed of sound and which, immediately before impact, is brought to a temperature lower than the melting temperature of the powder particles, but sufficiently high to reduce their mechanical properties so that the particles undergo plastic deformation during deposition of the powders. Even though it is envisaged using particles of different materials to be deposited on the substrate simultaneously or in sequence, as well as being able to add to the carrier gases chemical additives which are able to modify the chemical properties of the particles, this patent makes no mention of possible reactions or phase transformations following impact.

Finally the Applicant wishes to mention U.S. Pat. No. 7,402,277 which teaches depositing using the cold spraying technique a mixture of powders formed by metal particles, and a foaming agent, and then heating said agent above its decomposition temperature in order to obtain a porous coating.

OBJECT OF THE INVENTION

The main object of the present invention is to provide a method for forming a coating on a solid substrate, using powders of inorganic materials particularly suitable for deposition by means of cold spraying.

Other objects, arising from the previous object, are those of providing a coating obtained by means of this method.

Another object is that of providing an article comprising a coating which, owing to a choice of the starting materials of the powders, may have widely varying properties and may therefore be used in numerous sectors for different purposes.

SUBJECT-MATTER OF THE INVENTION

According to the present invention this object and other objects are obtained according to the accompanying claims.

EMBODIMENTS OF THE INVENTION

The following description is provided solely in order to clarify the characteristic features and the advantages of the present invention since it may be also made realized differently within the limits defined by the accompanying claims.

For the reasons which will be readily clarified the present description cites fully the following patents and patent applications which have as sole author or co-author the present inventor: EP665770, EP1670607; EP1873190; IT1399822; WO2012085782 which deal varyingly with the topic of control and modification of the phases which may also have dimensions of a few tens of nanometers, within particles forming part of powders suitable for industrial use.

The present invention uses the method known as cold spraying, namely propulsion of a flow formed by a powdery material and at least one carrier gas so that it strikes at high speed a solid substrate to be coated.

Advantageously, for the propulsion of this flow a convergent-divergent Laval nozzle may be used so that the flow has an impact speed greater than 340 m/s.

The particles which form the powdery material of this flow are obtained from inorganic materials and have dimensions smaller than 200 μm.

One or more mixtures of phase transformation or reaction precursor reagents (as specified hereinabove, these terms are used with the same meaning in the present patent) are present in at least some of the said particles, the said mixtures being obtained from at least one pair of phases.

The present invention uses the kinetic energy of the flow obtained from a speed of impact on the substrate greater than 350 m/s (and preferably greater than 1000 m/s), together with, where necessary, a subsequent heat treatment, so as to develop at least partially in the said mixtures a reaction (or phase transformation) characterized by an adiabatic temperature of at least 800° C.

The result of said reaction is that at least 30% by volume of the coating of the substrate is formed at the end by phases different from the initial phases in the starting powders.

In a preferred embodiment the inorganic starting materials are such that 50% by weight of the particles contain at least 50% by weight of the mixtures of reaction (or phase transformation) precursor reagents.

Even though it is possible to use other methods, in a preferred embodiment, the powders of the present invention consist of particles in which the phases present have dimensions smaller than 100 nanometers for an amount of at least 80% by volume owing to a treatment in which the same are obtained by subjecting the inorganic starting materials to a high-energy milling treatment, obviously upstream of formation of the flow which strikes the solid substrate together with the at least one carrier gas.

In particular, the high-energy milling treatment may be obtained with a high-energy mill or with a mechanical/chemical reactor such as those which form the subject-matter of EP665770 and WO2012085782, (the contents of which are cited here in full as reference source, as already mentioned above).

This apparatus is characterized by subjecting the treated materials to high energy densities resulting from the mechanical impact of milling means (typically at least 400 W/dm3 of treated material) in a controlled atmosphere.

The effects of high-energy milling, which are made use of in a preferred embodiment of the present invention, may be summarised (individually or in combinations) as follows:

1) mixing of different substances (elements or compounds or phases) on mixing scales which may be adjusted, down to the size of a few nanometers;

2) synthesis of alloys or compounds by means of a prolonged milling effect such as to combine elements and form alloys (mechanical/chemical processes, mechanical alloying);

3) reduction of the size of the (e.g. metal) crystals to dimensions of a few nanometers;

4) generation of particles which combine the above effects as (phase/crystal) aggregates with dimensions typically of tens of microns.

The present invention offers a wide possible choice of initial phases in the powders to be deposited on a substrate, also depending on the application area of the coating obtained.

It is possible in fact to obtain a coating having a high resistance to wear and/or to corrosion, but also, for example, a coating having self-lubricating properties so as to be applied on a moving substrate with minimum friction on another part of a mechanical device.

Among the many possible options, the present invention considers the following options for reaction (or phase transformation) reagent precursors of powders suitable for deposition on a solid substrate:

chemical reaction or phase transformation reagent precursors consisting of an amount of at least 20% by volume of a metal and a metal carbide and/or a metal and carbon. The metals (at least one chosen from Ti, Co, Al, Fe, Hf, V, Y, Zr) must be present at least in an amount of 5% by volume and the carbides (at least one chosen from among the carbides of W, Fe, Cr, Si) at least in amount of 30% by volume.

chemical reaction or phase transformation reagent precursors consisting of an amount of at least 20% by volume of metals or metal oxides: both metals (at least one chosen from Ti, Al, Mg, Y, Zr, Hf, Fe) and oxides (at least one chosen from the oxides of W, Si, Fe, Cu, Cr, Mo, Sn) must be present at least in an amount of 5% of volume;

chemical reaction or phase transformation reagent precursors consisting of an amount of at least 20% by volume of a first metal and a second metal for the formation of intermetallic compounds.

For many of the possible options of the initial phases the aforementioned reactions (or phase transformations of the mixtures) following deposition of the powders are concluded according to the predefined requirements by means of activation of the reactions during the impact (considering that the speed of impact of the flow on the solid substrate may also be greater than 1000 m/s) and their spontaneous progression caused by the high adiabatic temperatures.

Advantageously, after the cold spraying step at least 20% by volume of the coating consists of phases different from those of the starting powders.

In other cases, use of the kinetic energy of the flow combined with the adiabatic reaction temperature is not sufficient to complete or even start the reaction (or phase transformation) of the reaction precursors present in the mixtures. In these cases the present invention envisages a thermal heating treatment following deposition of the powders on the substrate which provides the necessary amount of heat for development and completion of the reactions in the coating.

The thermal treatment may obviously take place in line with the deposition process, i.e. substantially continuously without having to move the substrate, or subsequently and/or with different positioning of the substrate. The thermal treatment may consist of heating by means of electromagnetic induction. Alternatively, it is possible to use localized heat sources such as laser rays, electron beams, microwaves or simply an oven treatment.

EXAMPLE NO. 1

Reactive System: Metals (Fe, Cu, Al) and Oxide ($Fe_2O_3$)

The reference reaction in this system is:

$$Fe_2O_3+2Al=2Fe+Al_2O_3$$

which is characterized by an adiabatic temperature of 3100° C.

The inorganic starting materials are Fe, Cu and Al powders with an average particle size of 50 μm and $Fe_2O_3$ with an average particle size of 10 μm (having an overall weight of 10 kg) and proportions such as to allow the formation of about 20% by weight of $Al_2O_3$. The milling treatment which the materials undergo in a high-energy mill of the type described in EP665770 and WO201285782 (using a weight ratio of spherical milling bodies to treated material of about 10:1) has a duration of 1.5 hours. After this treatment, the powders which then form with at least one carrier gas the flow propelled by means of the cold spraying technique onto the substrate are thus formed by a fine mixture of $Fe_2O_3$, Al (reaction precursor reagents) as well as Fe, Cu with a crystal size of 20 nm and average powder size of 80 μm. After deposition of the powders by means of cold spraying, the coating is formed (following the reaction which produces $Al_2O_3$) by an amount of 20% by weight of $Al_2O_3$, the remainder being formed by an alloy of Fe/Cu/Al 70% with Vickers hardness HV450. In the coating the dimensions of the crystals of the various phases are substantially similar to the starting powders, and likewise for the new phase (Al2O3).

EXAMPLE NO. 2

Reactive System: Metal (Ti) and Carbide (SiC)

In this system there are two reference reactions:

$$SiC+Ti=Si+TiC \quad (1)$$

$$Ti+Si=TiSi2 \quad (2)$$

which are characterized by an adiabatic temperature of 1400° C. (reaction 1) and 1900° C. (reaction 2), respectively.

The inorganic starting materials are Ti and SiC powders (with an overall weight of 10 kg and in proportions such as to allow the formation of about 15% by weight of TiSi2), respectively, with average particle size of 60 μm and 10 μm. The milling treatment which they undergo in a high-energy mill of the type described in EP665770 and WO2012085782 (using a weight ratio of spherical milling bodies to treated material of about 10:1) has a duration of 1 hour.

The powders which then form with at least one carrier gas the flow propelled by means of the cold spraying technique onto the substrate are thus formed by a fine mixture of Ti and SiC (reaction precursor reagents) with a crystal size of 20 nm and average powder size of 40 microns. After deposition of the powders by means of cold spraying, the coating is therefore formed by Ti and SiC. A subsequent thermal heating treatment in an oven for one hour at 560° C., in addition to increasing the hardness to 1200 FIV, also completes both the aforementioned reactions (1) and (2), namely the formation of carbide TiC and the intermetallic compound TiSi2. In the coating the dimensions of the crystals of the various phases are substantially similar to the starting powders, and likewise for the new phases (TiC and TiSi2).

EXAMPLE NO. 3

Reactive System: Metal (Ti) and Carbide (WC)

The reference reaction in this system is:

$$Ti+WC=W+TiC$$

which is characterized by an adiabatic temperature of 1800° C.

The inorganic starting materials are Ti and WC powders (with an overall weight of 10 kg and in proportions such as to allow the formation of about 20% by weight of TiC, while leaving an amount of WC equal to 20%), respectively, with average particle size of 60 μm and 20 μm. The milling treatment which they undergo in a high-energy mill of the type described in EP665770 and W02012085782 (using a weight ratio of spherical milling bodies to treated material of about 10:1) has a duration of 2 hours.

The powders which then form with at least one carrier gas the flow propelled by means of the cold spraying technique onto the substrate are thus formed by a fine mixture of Ti and WC (reaction precursor reagents) with a crystal size of 20 nm and powders having average size of 30 microns. After deposition of the powders by means of cold spraying, the coating is formed by Ti and WC. Subsequent thermal heating treatment in an oven for one hour at 600° C. increases the hardness to 1100 HV, with the formation of TiC (20% by weight), the remainder being formed by about 20% of WC. In the coating the dimensions of the crystals of the various phases are substantially similar to the starting powders, and likewise for the new phase (TiC).

EXAMPLE NO. 4

Reaction Precursors: Metal (Ti) and Carbon (C)

The reference reaction in this system is:

$$Ti+C=TiC$$

which is characterized by an adiabatic temperature of 3000° C.

The inorganic starting materials are Ti and graphite powders (with an overall weight of 10 kg and proportions such as to allow the formation of about 30% by weight of TiC), respectively, with average particle size of 50 μm and 1 μm. The milling treatment which they undergo in a high-energy mill of the type described in EP665770 and WO2012085782 (using a weight ratio of spherical milling bodies to treated material of about 10:1) has a duration of 1 hour. The powders which form with at least one carrier gas the flow propelled by means of the cold spraying technique onto the substrate are thus formed by a fine mixture of titanium and carbon (reaction precursor reagents) with a crystal size of 20 nm and average powder size of 50 microns. After deposition of the powders by means of cold spraying the coating is formed (following the reaction for formation of the TiC) by TiC (25%), titanium (70%) and unreacted carbon (5%), with a Vickers hardness of HV420. A thermal heating treatment for one hour at 500° C. increases the hardness to 520 HV, completing the reaction with formation of a coating consisting of titanium (70%) and TiC (30%). In the coating the dimensions of the crystals of the various phases are substantially similar to the starting powders, and likewise for the new phase (TiC).

The person skilled in the art, in order to satisfy specific requirements, may make modifications to the embodiments described above and/or replace the parts described with equivalent parts, without thereby departing from the scope of the accompanying claims.

The invention claimed is:

1. Method for forming a surface coating on at least a part of a solid substrate, comprising:

cold spraying a flow comprising at least one carrier gas and particles suitable for deposition on said substrate, said flow having a speed greater than 350 m/s;

wherein said particles are obtained from inorganic materials subjected to a high-energy milling treatment and have dimensions smaller than 200 μm;

wherein one or more mixtures of reaction precursor reagents are present in at least some of said particles, said mixtures comprise at least one pair of phases;

wherein the mixtures of reaction precursor reagents present in at least some of the particles strike the substrate and comprise at least one first reagent of metals or a mixture of metals and at least one second reagent of one or more of boron, borides, carbon, carbides, oxides and nitrides, wherein the mixtures of reaction precursor reagents during the cold spraying result in an adiabatic reaction temperature of at least 800° C., so that at least 20% by volume of the coating is formed by phases different from those of the starting powders.

2. Method according to claim 1, characterized in that the mixtures of reaction precursor reagents are characterized by at least one reaction having an adiabatic temperature greater than 1000 ° C.

3. Method according to claim 1, characterized in that at least 50% by weight of the particles which strike the substrate are particles which contain at least 50% by weight of the mixtures of reaction precursor reagents.

4. Method according to claim 1, characterized in that the phases present in at least 80% by volume of the particles which strike the substrate and from which they are formed have dimensions smaller than 100 nm.

5. Method according to claim 1, characterized in that, at a time following that of impact of the flow, the coating is subjected to a thermal heating treatment subsequent to the cold spraying.

6. Method according to claim 5, characterized in that the substrate is also subjected to heating.

7. Method according to claim 5, characterized in that the thermal treatment consists of heating which is localized in a part of the coating.

8. Method according to claim 5, characterized in that the thermal treatment consists of heating by means of electromagnetic induction of the coating.

9. Method according to claim 5, characterized in that the thermal treatment consists of a heating method chosen from among: laser rays, electron beams or microwaves.

10. Method according to claim 9, characterized in that at least one of the following metals is present in at least 5% by volume of the mixtures of reaction precursor reagents: Ti, Co, Al, Fe, Hf, V, Y, Zr and that at least one of the carbides of the elements: W, Fe, Cr, Si is present in at least 30% by volume of the mixtures of reaction precursor reagents.

11. Method according to claim 9, characterized in that at least one of the following metals is present in at least 5% by volume of the mixtures of reaction precursor reagents: Ti, Al, Mg, Y, Zr, Hf, Fe and that at least one of the oxides of the elements: W, Si, Fe, Cu, Cr, Mo, Sn is present in amount of at least 5% by volume of the mixtures of reaction precursor reagents.

12. Method according to claim 1, wherein the coating has a thickness greater than 5 μm.

13. Method according to claim 12, wherein the coating has a thickness greater than 50 μm.

14. Method according to claim 1, characterized in that at least 30% by volume of the coating is formed by phases different from those of starting powders.

15. Method according to claim 1, characterized in that the speed of the flow is greater than 1000 m/s.

* * * * *